US005678365A

United States Patent [19]

Venegas, Jr.

[11] Patent Number: 5,678,365

[45] Date of Patent: Oct. 21, 1997

[54] ROTATING GUARD RAIL ASSEMBLY

[76] Inventor: Frank Venegas, Jr., 4165 Homestead, Howell, Mich. 48843

[21] Appl. No.: 570,094

[22] Filed: Dec. 11, 1995

Related U.S. Application Data

[62] Division of Ser. No. 540,748, Oct. 11, 1995, which is a continuation of Ser. No. 179,089, Jan. 10, 1994, abandoned.

[51] Int. Cl.[6] ..... F01F 15/00

[52] U.S. Cl. ..... 52/174; 52/173.2; 52/721.4; 52/65; 49/9; 49/460; 256/13.1; 404/6

[58] Field of Search ..... 52/2.12, 111, 155, 52/156, 173.2, 174, 724, 721.5, 65; 49/40–42, 45, 381, 460, 9; 256/13.1, 19; 404/6, 9, 10; 248/161, 165

[56] References Cited

U.S. PATENT DOCUMENTS

| | | | |
|---|---|---|---|
| 3,416,484 | 12/1968 | Chapman | 404/6 X |
| 3,602,109 | 8/1971 | Harrigton | 404/6 X |
| 3,667,405 | 6/1972 | Roach, Jr. | 52/727 X |
| 4,021,977 | 5/1977 | Deike | 52/298 X |
| 4,183,505 | 1/1980 | Maestri | 256/13.1 |
| 4,928,430 | 5/1990 | George | 49/460 |
| 5,022,349 | 6/1991 | Bryant et al. | 248/156 |
| 5,033,905 | 7/1991 | Schmidt et al. | 404/9 X |
| 5,323,583 | 6/1994 | Venegas, Jr. | 52/727 |

FOREIGN PATENT DOCUMENTS

| | | | |
|---|---|---|---|
| 1017915 | 8/1964 | United Kingdom | 256/13.1 |

*Primary Examiner*—Carl D. Friedman
*Assistant Examiner*—Winnie Yip
*Attorney, Agent, or Firm*—Gifford, Krass, Groh, Sprinkle, Patmore, Anderson & Citkowski, P.C.

[57] ABSTRACT

A rotating guard rail assembly formed preferably of steel tubing and sheathed in a polymerized material such as plastic. The assembly generally comprises a vertical stanchion sheathed in plastic and having a rotating jacket assembly mounted about the exterior of the stanchion. The jacket is free to rotate about the stanchion thereby acting as a cornering or pivoting device to redirect a moving object upon impact of the guard rail assembly.

5 Claims, 2 Drawing Sheets

2
2
10
12
20
22
24
14
16
18

12
20
24
14
26
28
30
16
18

4
4
36
32
34
10
52
54
46
35
42
40
44

36
32
34
54
54
52
50
48
46
40
38
42
44

ROTATING GUARD RAIL ASSEMBLY

This is a divisional of application Ser. No. 08/540,748 filed on Oct. 11, 1995, which is a continuation of application Ser. No. 08/129,089 filed on Jan. 10, 1994, now abandoned.

BACKGROUND OF THE INVENTION

I. Field of the Invention

The present invention relates generally to a rotating guard rail assembly. More specifically, the present invention relates to a rotating guard rail assembly that acts as a rotating guide to pivot a device such as a grocery cart about a barrier or a corner.

II. Description on the Relevant Art

Previously known guard rail assemblies for use as barriers generally are comprised of a hard building material such as concrete. These barriers may be placed exterior of a structure, such as a gasoline pump station, a grocery cart parking lot enclosure, or, as a barrier between an entrance and an exit way. These concrete barriers may be painted to enhance the overall look of the barrier.

A disadvantage of these barriers is that, when a moving object, such as an automobile, strikes the barrier, extensive damage may be caused to the automobile and the barrier itself. This damage may include chipping of the paint coating the barrier and, further, splitting or fragmenting pieces of concrete from the barrier itself.

A further disadvantage of the concrete barrier is that exposure to extreme weather conditions causes the concrete to chip from the top of the barrier.

If the barrier is damaged in any of the above ways, the barrier, at the very least, may need to be repainted and, possibly, need to be replaced.

A still further disadvantage of these previously known barriers is that the barrier does not aid in careening or cornering an object away from the barrier, but rather, acts as a barricade and absorbs the full force of the object as it strikes the barrier.

SUMMARY OF THE PRESENT INVENTION

The present invention relates to a rotating guard rail assembly that is generally formed of a metal material such as steel, and sheathed in a polymerized material, such as plastic.

A housing, such as a jacket or ring, is mounted about the exterior of the polymerized sheath. The jacket or ring will rotate a moving object about a guard rail assembly rather than absorbing the full impact of the object upon contact with the assembly. The jacket or ring is also preferably formed of a polymerized material, such as plastic.

An advantage of this rotating guard rail assembly is that the polymerized sheath and rotating jacket or ring will endure any weather condition. A further advantage of the assembly is that the polymerized material prevents rusting or chipping of the barrier when an object impacts the barrier.

A still further advantage of the rotating guard rail assembly is that the assembly may be used to act as a cornering or pivoting device to redirect a moving object upon impact of the guard rail assembly.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENTS OF THE PRESENT INVENTION

Figures 1, 2, 3, 4:
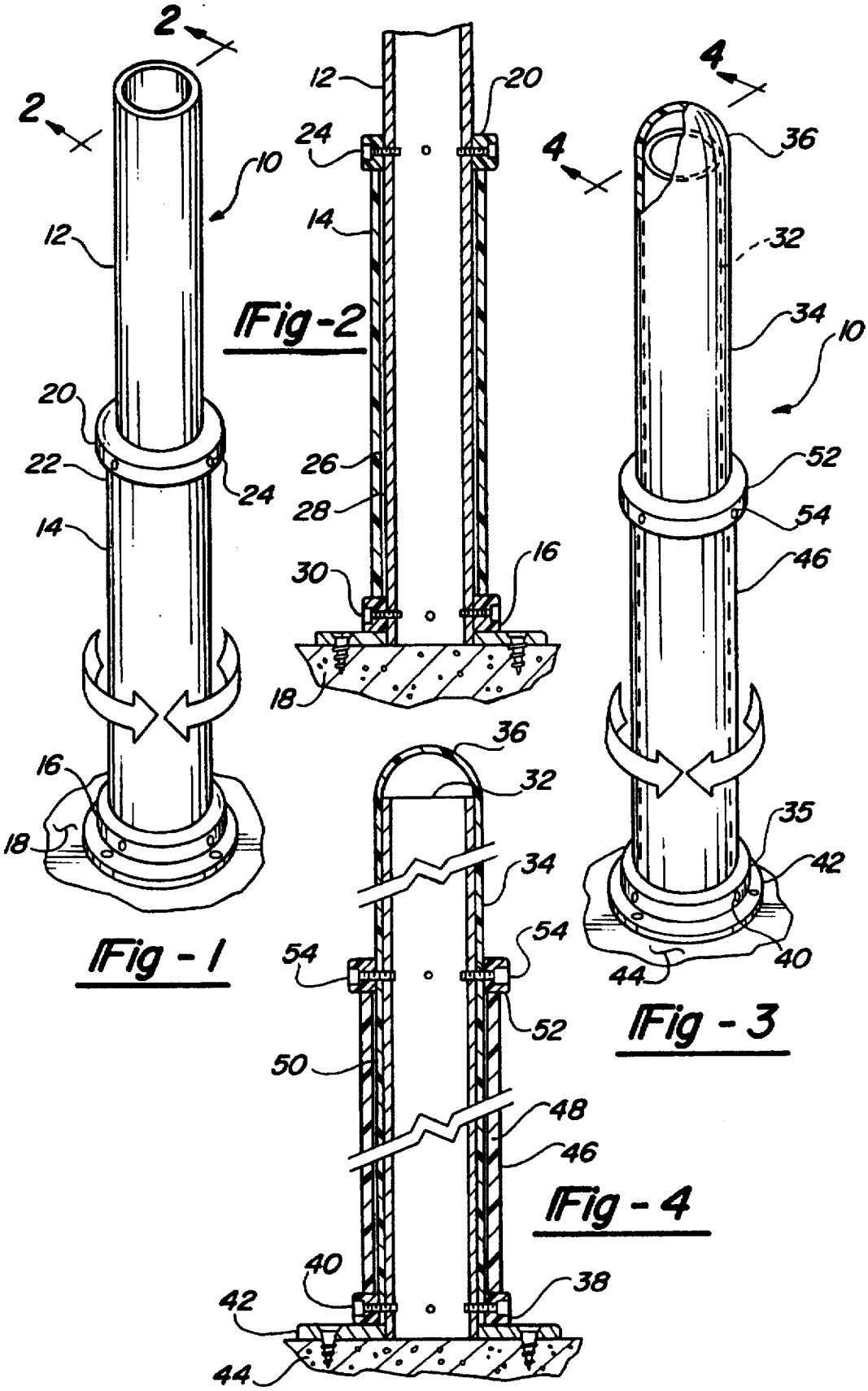
FIG. 1 is a perspective view of a preferred embodiment of a rotating guard rail assembly, according to the present invention associated therewith.
FIG. 2 is a cross-sectional view taken along Line 2—2 of FIG. 1.
FIG. 3 is a perspective view of a second preferred embodiment of a rotating guard rail assembly.
FIG. 4 is a cross-sectional view taken along Line 4—4 of FIG. 3.

The drawing discloses the preferred embodiments of the present invention. While the configurations according to the illustrated embodiments are preferred it is envisioned that alternate configurations of the present invention may be adapted without deviating from the invention as portrayed. The preferred embodiments are discussed hereafter.

With reference to FIG. 1, a rotating guard rail assembly 10 includes a vertical stanchion 12, preferably formed of a steel pipe. A jacket 14 is rotatably mounted about vertical stanchion 12. Jacket 14 is preferably formed of a polymerized material, such as plastic.

Base 16 comprises a ring formed preferably of a polymerized material, such as plastic. Base 16 supports the vertical stanchion 12 in an upright position and further provides means for supporting vertical stanchion 12 to a foundation 18.

A second ring 20, having an interior diameter equal to the outer diameter of vertical stanchion 12, is placed about vertical stanchion 12 and rests on the upper end 22 of jacket 14 opposite base ring 16. Ring 20 is preferably formed of a polymerized material, such as plastic, and is fixedly engaged to vertical stanchion 12 by mechanical means, such as allen screws 24.

With reference to FIGS. 1 and 2, jacket 14 has an interior diameter 26 slightly larger than outer diameter 28 of vertical stanchion 12. Jacket 14 rests unsecured between base 16 and ring 20. Thus, jacket 14 rotates freely about vertical stanchion 12. Base 16 is fixedly secured to vertical stanchion 12 by mechanical means, such as allen screws 30. With vertical stanchion 12 secured to foundation 18, jacket 14 acts as a radial pivot, redirecting a moving object away from rotating guard rail assembly 10 when an object strikes the assembly.

With reference now to FIGS. 3 and 4, a second preferred embodiment is thereshown having a vertical stanchion 32. Vertical stanchion 32 is preferably formed of a metal, such as steel tubing.

A sheath 34, preferably formed of a polymerized material, such as plastic, extends about vertical stanchion 32. Sheath 34 extends above vertical stanchion 32, preferably in a dome-like fashion 36, fully encasing vertical stanchion 32, thereby protecting stanchion 32 from extreme weather conditions.

Base 38 comprises a ring surrounding sheath 34 and is secured to sheath 34 by mechanical means, such as allen screws 40. Lower portion 42 of base 38 extends beyond the outer diameter of base 38 and provides support means for securing vertical stanchion 32 to a foundation 44, such as cement.

A jacket 46, preferably formed of a polymerized material, such as plastic, is mounted about vertical stanchion 32 and rests freely on base 38. Jacket 46 has an interior diameter 48 greater than the outer diameter 50 of sheath 34. A second ring 52 is mounted about vertical stanchion 32 around the exterior of sheath 34. Ring 52 lies above base 38 and jacket 46. Ring 52 is fixedly mounted to vertical stanchion 32 by mechanical means, such as allen screws 54. Since jacket 46 is not fixedly secured to either the base 38 or ring 52, jacket 46 is free to rotate about vertical stanchion 32 when an object impacts the guard rail assembly 10.

Thus the advantage of the rotating guard rail assembly 10, as shown in FIGS. 3 and 4, is two-fold. By encasing the vertical stanchion 32 completely in a polymerized sheath 34, vertical stanchion 32 is fully weather-proofed and does not need painting. Secondly, rotating polymerized jacket 46 minimalizes damage to a moving object when the object strikes the guard rail assembly in the area of the jacket or in the area above the jacket.

Figure 5:
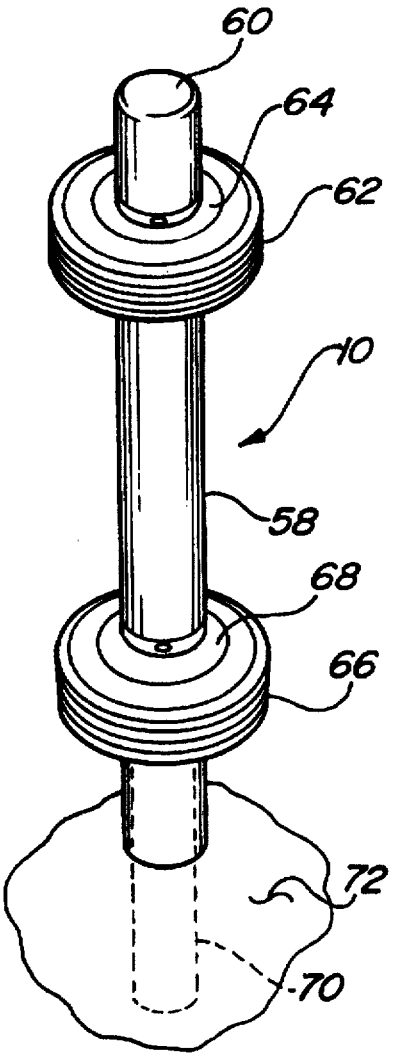
FIG. 5 is a perspective view of a third preferred embodiment of a rotating guard rail assembly.
Figure 6:
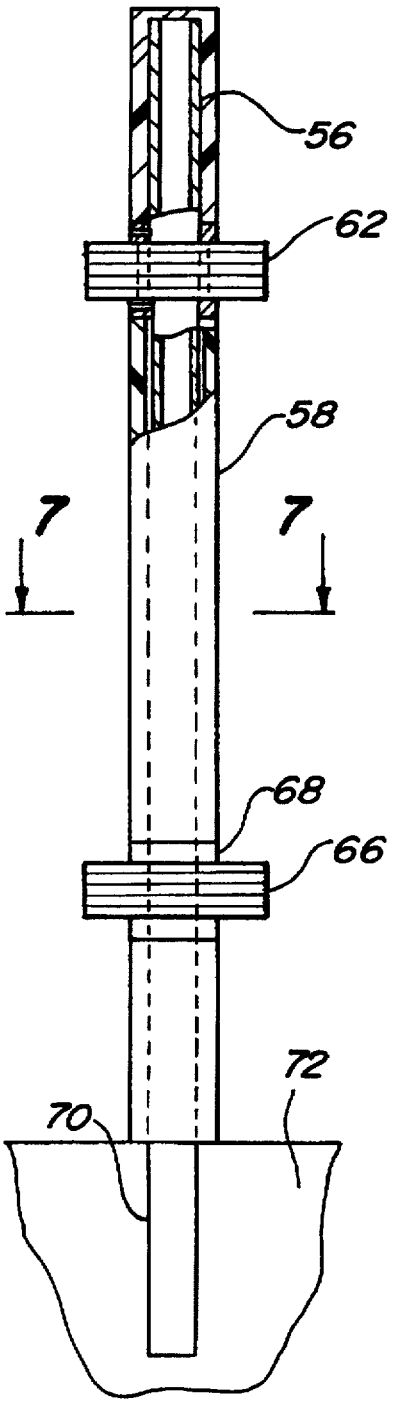
FIG. 6 is a cross-sectional view of the rotating guard rail assembly shown in FIG. 5, taken from the front.
Figure 7:
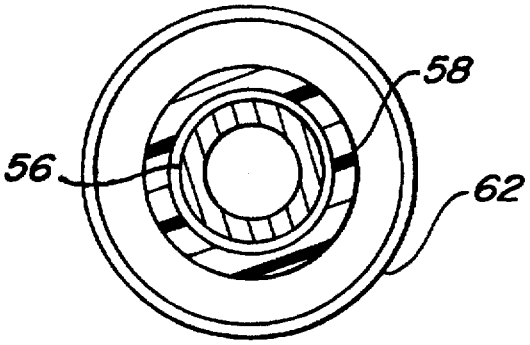
FIG. 7 is a cross-sectional view taken along Line 7—7 of FIG. 6.

With reference now to FIGS. 5 through 7, a third preferred embodiment of the rotating guard rail assembly is thereshown. Vertical stanchion 56 is provided therewith, and preferably formed of a metal, such as steel tubing.

Sheath 58 extends about vertical stanchion 56 completely encasing it. A separate cap 60 may be provided at the top of vertical stanchion 56 to further protect vertical stanchion 56 from extreme weather conditions.

First ring 62 is fixedly mounted at its hub 64 about sheath 58 of vertical stanchion 56. Ring 62 rotates freely about hub 64.

A second ring 66 is located on vertical stanchion 56 below first ring 62. Ring 66 is fixedly mounted to vertical stanchion 56 about sheath 58 by hub 68. Ring 66 rotates freely about hub 68.

Vertical stanchion 56 extends beyond sheath 58, as shown at reference numeral 70. Extension 70 provides a means for fixedly securing the rotating guard rail assembly 10 to a foundation 72, such as cement.

Since rings 62, 66 rotate freely about vertical stanchion 56, the guard rail assembly 10 can be used to pivotably guide an object about the assembly 10. For instance, the guard rail assembly shown in FIGS. 5 through 7 may be placed at an entrance way ramp to a grocery store to help guide a chain of grocery carts through the entryway of the door. A further advantage of the rotating guard rail assembly 10 is that the assembly 10 can be placed at the corners of any aisle way in a store or about an exhibit or kiosk to prevent a moving object from hitting the exhibit or kiosk and knocking it over.

Having described my invention, however, many modifications thereto will become apparent to those skilled in the art to which it pertains without deviation from the spirit of the invention as defined by the scope of the appended claims.

I claim:

1. A rail assembly comprising:

a vertical stanchion;

a polymerized sheath continuously mounted about said vertical stanchion;

a first ring rotatably mounted to said polymerized sheath;

a second ring rotatably mounted to said polymerized sheath; and wherein said first and second rings having equal outer diameters and said outer diameters are greater than an outer diameter of said polymerized sheath; whereby said first and second rings absorb the initial impact of an object in motion.

2. The rail assembly defined in claim 1, wherein said vertical stanchion extends beyond said polymerized sheath for fixedly securing said rail assembly to a foundation.

3. The rail assembly defined in claim 1, wherein said first and second rings are formed of a polymerized material.

4. A rail assembly comprising:

a vertical stanchion; and rotating means for redirecting a moving object about a horizontal plane around said vertical stanchion, said rotating means comprising a polymerized sheath extending about and affixed to said vertical stanchion; a first ring fixed to one end of said polymerized sheath and extending outwardly from said polymerized sheath; and a second ring spaced apart from said first ring and fixed to the opposite end of said polymerized sheath; wherein said first and second rings are rotatable about said polymerized sheath for absorbing an initial impact of the object in motion.

5. The rail assembly defined in claim 4, wherein said vertical stanchion extends beyond said polymerized sheath for fixedly securing said rail assembly to a foundation.

* * * * *